US006125805A

United States Patent [19]

Sato et al.

[11] Patent Number: 6,125,805

[45] **Date of Patent: *Oct. 3, 2000**

[54] VALVE OPERATING SYSTEM IN INTERNAL COMBUSTION ENGINE

[75] Inventors: Toshiyuki Sato; Toshihiro Oikawa; Yutaka Otobe, all of Wako, Japan

[73] Assignee: Honda Giken Kogyo Kabushiki Kaisha, Tokyo, Japan

[ * ] Notice: This patent is subject to a terminal disclaimer.

[21] Appl. No.: 09/420,409

[22] Filed: Oct. 19, 1999

Related U.S. Application Data

[62] Division of application No. 09/102,630, Jun. 23, 1998, Pat. No. 5,979,379.

[30] Foreign Application Priority Data

| | | | |
|---|---|---|---|
| Jun. 24, 1997 | [JP] | Japan | 9-167235 |
| Jun. 25, 1997 | [JP] | Japan | 9-168034 |
| Jun. 27, 1997 | [JP] | Japan | 9-171852 |

[51] Int. Cl.[7] ..... F01L 13/00

[52] U.S. Cl. ..... 123/90.16; 123/90.36; 123/90.42

[58] Field of Search ..... 123/90.15, 90.16, 123/90.17, 90.33, 90.34, 90.36, 90.39, 90.42, 90.5, 90.51, 90.66

[56] References Cited

U.S. PATENT DOCUMENTS

| | | | |
|---|---|---|---|
| 5,456,225 | 10/1995 | Oikawa et al. | 123/90.16 |
| 5,460,130 | 10/1995 | Fukuzawa et al. | 123/90.16 |
| 5,515,820 | 5/1996 | Sugimoto et al. | 123/90.16 |
| 5,592,907 | 1/1997 | Hasebe et al. | 123/90.16 |
| 5,669,342 | 9/1997 | Speil | 123/90.16 |

FOREIGN PATENT DOCUMENTS

| | | |
|---|---|---|
| 0 267 696A1 | 5/1988 | European Pat. Off. . |
| 0 826 867A1 | 3/1998 | European Pat. Off. . |
| 44 33 457 A1 | 3/1996 | Germany . |
| 2-50286 | 11/1990 | Japan . |

*Primary Examiner*—Weilun Lo

*Attorney, Agent, or Firm*—Arent Fox Kintner Plotkin & Kahn PLLC

[57] ABSTRACT

A valve operating system in an internal combustion engine includes a cam shaft provided with a plurality of valve operating cams, a plurality of rocker arms positioned adjacent one another, an associative operation switch capable of being switched between a state in which it permits the rocker arms adjacent each other to be operated associatively with each other, and a state in which it releases the associative operation. An urging means for urging the free rocker arm of the plurality of rocker arms toward the valve operating cam corresponding to the free rocker arm, which becomes free relative to an engine valve, when the associative operation switch is brought into the associative operation releasing state. The free rocker arm is provided with first and second support walls spaced apart and opposed to each other, and a roller is provided in rolling contact with a valve operating cam corresponding to the free rocker arm, and is rollably supported on a support shaft mounted to extend between the support walls through a bearing. In such valve operating system, one of the support walls included in the free rocker arm is integrally provided with a receiving portion which contacts with the urging means. Therefore, the structure of the free rocker arm can be simplified in such a manner that the receiving portion is positioned to the side of the roller. In addition, an increase in size of the free rocker arm can be avoided, and the inertial weight is reduced. Thus, it is possible to conveniently accommodate the high-speed rotation of the internal combustion engine.

19 Claims, 11 Drawing Sheets

VALVE OPERATING SYSTEM IN INTERNAL COMBUSTION ENGINE

This application is a divisional application filed under 37 CFR § 1.53(b) of parent application Ser. No. 09/102,630, filed Jun. 23, 1998, now U.S. Pat. No. 5,979,379.

BACKGROUND OF THE INVENTION

1. Field of the Invention

The present invention relates to a valve operating system in an internal combustion engine, in which a support shaft is mounted to extend between first and second support walls included in a rocker arm, and the rocker arm is urged by an urging means in a direction to bring a roller into rolling contact with a valve operating cam.

2. Description of the Related Art

A valve operating system of the above type is already known from Japanese Patent Publication No. 2-50286 and the like. In such known valve operating system, a receiving portion is provided at a widthwise central portion of the rocker arm in a direction parallel to the axis of a rocker shaft on which the rocker arm is swingably supported. However, due to the fact that the receiving portion is positioned at the central portion of the rocker arm, despite the provision of the roller, the structure of the rocker arm is complicated, and the size of the rocker arm is increased, resulting in an increased weight.

SUMMARY OF THE INVENTION

Accordingly, it is an object of the present invention to provide a valve operating system in an internal combustion engine, wherein the complicated structure of a rocker arm receiving a spring force from an urging means and the increase in size can be avoided.

To achieve the above object, according to a first aspect and feature of the present invention, there is provided a valve operating system in an internal combustion engine, comprising a cam shaft provided with a plurality of valve operating cams, a plurality of rocker arms positioned adjacent one another, an associative operation switching means capable of being switched between a state in which it permits the rocker arms adjacent each other to be associatively operated with each other, and a state in which it releases the associative operation, and an urging means for urging the free rocker arm of the plurality of rocker arms toward a valve operating cam corresponding to the free rocker arm, which becomes free relative to an engine valve, when the associative operation switching means is brought into the associative operation releasing state. The free rocker arm has first and second spaced support walls opposed to each other, and a roller is provided in rolling contact with the valve operating cam corresponding to the free rocker arm, and is rollably supported on a support shaft mounted to extend between the first and second support walls through a bearing. One of the support walls included in the free rocker arm is integrally provided with a receiving portion which contacts with the urging means.

With the above arrangement, the structure of the free rocker arm can be simplified such that the receiving portion is positioned to the side of the roller, and an increase in size of the free rocker arm can be avoided and further, the inertial weight is decreased. Therefore, it is possible to conveniently accommodate the high-speed rotation of the internal combustion engine.

According to another feature of the present invention, the first support wall of the free rocker arm has a first fitting bore therein, with one end of the support shaft being fitted into the first fitting bore, and the second support wall having the receiving portion includes a second fitting bore therein coaxially with the first fitting bore, the other end of the support shaft being fitted into the second fitting bore. The support wall has an insert bore leading to an inner surface of the first fitting bore, and the support shaft has an engage groove in an outer surface thereof corresponding to an opening of the insert bore into the inner surface of the first fitting bore. A pin engaged in the engage groove is inserted into and fitted in the insert bore. With such an arrangement, the axial movement of the support shaft and the rotation of the support shaft about its axis are inhibited by the pin, whereby the support shaft is easily fixed. Further, the size and the position of the insert bore are not limited by the receiving portion. In addition, it is difficult for a load from the urging means to act on the pin, and the support strength of the support shaft can be increased.

According to another feature of the present invention, the rocker arms are positioned adjacent one another, so that one of the rocker arm other than the free rocker arm is positioned at one end in the direction of arrangement of the rocker arms, and the associative operation switching means switches between the associative operation and the releasing of the associative operation of the rocker arms in response to the operation of pistons caused by a variation in hydraulic pressure in a hydraulic pressure chamber defined in the one rocker arm. The support shaft has a cylindrical shape to guide the sliding operation of the pistons, and the free rocker arm is supported on a support member with the first support wall being positioned on the side of the one rocker arm. With such arrangement, the support shaft is fixed to the free rocker arm at a location in which the piston included in the associative operation switching means is inserted and hence, the insertion of the piston into the support shaft is smooth.

According to a further feature of the present invention, one of the first and second support walls included in the free rocker arm, which is provided with the receiving portion, includes a lubricating oil passage for supplying lubricating oil from an oil passage provided in a support member for supporting the free rocker arm for swinging movement, to the bearing of the free rocker arm. With such an arrangement, a reduction in rigidity of the support walls can be avoided by the receiving portion, notwithstanding that the hollow lubricating oil passage is defined. In addition, a reduction in weight of the support walls that is caused by the lubricating oil passage being hollow can be compensated for by the receiving portion, thereby improving the balance of weight of the support walls.

According to a further feature of the present invention, there is provided a valve operating system in an internal combustion engine, comprising a cam shaft provided with a valve operating cam, a rocker arm having first and second spaced support walls opposed to each other, a support shaft mounted to extend between the support walls, a roller which is rollably supported on the support shaft through a bearing, and an urging means for urging the rocker arm in a direction to bring the roller into rolling contact with the valve operating cam. One of the support walls included in the rocker arm, is integrally provided with a receiving portion which contacts with the urging means.

The structure of the rocker arm can thus be simplified such that the receiving portion is positioned to the side of the roller, and an increase in size of the rocker arm can be avoided and further, the inertial weight is decreased. Thus, it is possible to conveniently accommodate the high-speed rotation of the internal combustion engine.

According to another feature of the present invention, a support member for supporting the rocker arm is provided with an oil passage, and the first and second support walls are provided with fitting bores into which opposite ends of the support shaft are fitted, respectively. The rocker arm is provided with a lubricating oil passage which opens into an inner surface of at least one of the fitting bores included in the rocker arm and leads to an oil passage in the support member, and at least the one fitting bore has a groove in its inner surface with one end leading to the lubricating oil passage and with the other end opening toward the bearing.

With this arrangement, lubricating oil is supplied from the oil passage in the support member through the lubricating oil passage and the groove to the bearing. Thus, it is possible to supply lubricating oil to the bearing in a simple structure in which the lubricating oil passage is in the rocker arm and the groove is in the inner surface of at least one of the fitting bores. The oil passage structure for supplying lubricating oil to the bearing can be easily formed and moreover, it is unnecessary to drill the support shaft for introducing lubricating oil. Therefore, there is no reduction in rigidity of the support shaft, and further, the number of workings is reduced.

According to another feature of the present invention, a support member for supporting the rocker arm is provided with an oil passage, and at least one of the first and second support walls is provided with a lubricating oil passage which leads to the oil passage in the support member and opens toward the bearing.

With this feature, lubricating oil is supplied from the oil passage in the support member through the lubricating oil passage to the bearing. Thus, it is possible to supply lubricating oil to the bearing in a simple structure in which the lubricating oil passage is only in at least one of the support walls included in the rocker arm. The oil passage structure for supplying lubricating oil to the bearing can be easily formed and moreover, it is unnecessary to drill the support shaft for introducing lubricating oil. Therefore, there is not a possibility of reduction in rigidity of the support shaft, and further, the number of workings is reduced.

According to still another feature of the present invention, the valve operating system includes the cam shaft with a plurality of valve operating cams, and a plurality of the rocker arms positioned adjacent one another. A first particular rocker arm is operated following the high-speed valve operating cam of the valve operating cams, which has a cam profile permitting the maximum lift amount of an engine valve. An associative operation switching means includes pistons which are movable between a position in which the rocker arms positioned adjacent each other are operated in association with each other, and a position in which the associative operation is released. The first and second support walls in at least the first particular rocker arm of the plurality of the rocker arms are provided with fitting bores coaxially opposed to each other at a distance, and the support shaft is formed into a cylindrical shape to guide the sliding operation of the pistons and has opposite ends fitted into and fixed in the fitting bores. A support member supporting the first particular rocker arm is provided with an oil passage, the first particular rocker arm being provided with a lubricating oil passage which opens into an inner surface of at least one of the fitting bores and leads to the oil passage in the support member, the at least one fitting bore having a groove in its inner surface with one end leading to the lubricating oil passage and with the other end opening towards the bearing.

With this arrangement, lubricating oil is supplied from the oil passage in the support member through the lubricating oil passage and the groove to the bearing which is positioned between the support shaft of the first particular rocker arm corresponding to the high-speed valve operating cam, i.e., the rocker arm having a relatively large inertial weight and the roller. Thus, by effectively supplying lubricating oil to the bearing on which a relatively large load acts, the load on the bearing can be alleviated. Moreover, it is possible to supply lubricating oil to the bearing in a simple structure in which the lubricating oil passage is in the first particular rocker arm and the groove is in the inner surface of at least one of the fitting bores. The oil passage structure for supplying lubricating oil to the bearing can be easily formed and moreover, it is unnecessary to drill the support shaft for introducing lubricating oil. Therefore, there is no reduction in rigidity of the support shaft, and further, the number of workings is reduced.

According to still another feature of the present invention, the lubricating oil passage is in one of the support walls, and the other support wall is provided with an insert bore which leads to an inner surface of the fitting bore included in the other support wall. The support shaft has an engage groove in its outer surface corresponding to an opening of the insert bore into an inner surface of the fitting bore. A pin is engaged in the engage groove and is inserted into and fixed in the insert bore.

With this arrangement, the axial movement of the support shaft and the rotation of the support shaft about its axis are inhibited, whereby it is easy to fix the support shaft, and also the space for the insert bore can be ensured, while avoiding an increase in size of the rocker arm having the lubricating oil passage. In addition, the insert bore is provided at a location relatively far apart from the lubricating oil passage which is hollow. This is convenient for the rigidity of the rocker arm.

According to a further feature of the present invention, the rocker arms are positioned adjacent to one another such that the rocker arm other than the first rocker arm is positioned at one end in the direction of arrangement of the rocker arms, and the associative operation switching means including pistons for switching between the associative operation and the releasing of the associative operation of the rocker arms in response to the operation of the pistons caused by a variation in hydraulic pressure in a hydraulic pressure chamber defined in the other rocker arm. One of the support walls included in the first particular rocker arm, which is positioned adjacent the other rocker arm, includes an insert bore leading to an inner surface of the fitting bore in the support wall. The support shaft has an engage groove in its outer surface corresponding to an opening of the insert bore into the fitting bore, and a pin engaged in the engage groove is inserted into and fixed in the insert bore. The lubricating oil passage in one of the support walls, is positioned at a location spaced apart from the other rocker arm.

With this arrangement, the axial movement of the support shaft and the rotation of the support shaft about the axis are inhibited and hence, it is easy to fix the support shaft, and the space for the insert bore can be ensured, while avoiding an increase in size of the first particular rocker arm having the lubricating oil passage. In addition, the insert bore is at the location relatively far apart from the lubricating oil passage which is hollow. This is convenient for the rigidity of the first particular rocker arm. Further, the support shaft is fixed to the first particular rocker arm at a location in which the piston included in the associative operation switching means is inserted and hence, the insertion of the piston into the support shaft, i.e., the switching operation of the associative operation switching means, is smooth.

According to another feature of the present invention, the lubricating oil passage has a cross-sectional shape with a length longer in the direction substantially perpendicular to the axis of the cam shaft than a length in the direction substantially parallel to the axis of the cam shaft. With such arrangement, it is possible to reduce the space occupied by the lubricating oil passage in the direction parallel to the cam shaft to a minimum, and it is possible to reduce the size of the rocker arm having the lubricating oil passage.

According to still another feature of the present invention, the rocker arm is formed from a metal by injection molding. With such arrangement, the fitting bore and the lubricating oil passage can be formed simultaneously with the formation of the rocker arm, and the number of post-workings can be reduced to a minimum to enhance the productivity.

According to a further feature of the present invention, the valve operating system includes a plurality of the rocker arms positioned adjacent one another, including the rocker arm integrally provided with the receiving portion; and an associative operation switching means which includes a timing piston defining a hydraulic pressure chamber between the timing piston and the second particular rocker arm of the rocker arms, which is capable of switching to the associative operation and releasing of the associative operation of the plurality of rocker arms in response to the operation of the timing piston caused by a variation in hydraulic pressure in the hydraulic pressure chamber. The second particular rocker arm has a communication passage which permits an oil passage in a support member for supporting the second rocker arm for swinging movement, to communicate with the hydraulic pressure chamber. The communication passage has a cross-sectional shape with a length in the direction substantially perpendicular to the direction of arrangement of the rocker arms longer than a length in a direction substantially parallel to the direction of arrangement of the rocker arms, the communication passage being in the second particular rocker arm and extending along a plane substantially perpendicular to the direction of arrangement of the rocker arms.

With this arrangement, it is possible to reduce the space occupied by the communication passage in the direction substantially parallel to the direction of arrangement of the rocker arms, and it is possible to correspondingly reduce the size of the second particular rocker arm.

According to still a further feature of the present invention, a cylindrical support shaft is fixed to the second particular rocker arm which includes a first support wall having a first closed end fitting bore therein, and a second support wall having a second fitting bore therein, coaxially with the first fitting bore, that opens at opposite end thereof. The cylindrical support shaft has opposite ends fitted into the first and second fitting bores. A roller in rolling contact with one of a plurality of the valve operating cams, is rollably supported on the cylindrical support shaft, the timing piston is swingably fitted on the cylindrical support shaft, and the communication passage is in the first support wall of the second particular rocker arm.

It is thus possible to avoid an increase in thickness of the first support wall for supporting the roller, while ensuring the support strength of the support shaft, thereby contributing to a reduction in size of the second particular rocker arm.

According to another feature of the present invention, the support shaft has a notch in a portion at one end thereof, which corresponds to the communication passage, and the notch has a shape corresponding to the communication passage. With such arrangement, the communication passage can be positioned in proximity to the roller, while ensuring a sufficient contact area of the support shaft with the first fitting bore in the first support wall to ensure the support strength of the support shaft on the second particular rocker arm, and thus, the size of the second particular rocker arm can be further reduced.

According to a further feature of the present invention, the second support wall of the second rocker arm has an insert bore therein which leads to an inner surface of the second fitting bore and the cylindrical support shaft has an engage groove in its outer surface in correspondence to an opening of the insert bore into the inner surface of the second fitting bore. A pin engaged in the engage groove, is inserted into and fixed in the insert bore. With such arrangement, the axial movement of the support shaft and the rotation of the support shaft about its axis are inhibited, whereby it is easy to fix the support shaft, but also the space for provision of the insert bore can be ensured, while avoiding an increase in size of the second particular rocker arm. In addition, the insert bore is at a location relatively far apart from the lubricating oil passage which is hollow. This is convenient for the rigidity of the second particular rocker arm.

According to a still another feature of the present invention, the second particular rocker arm includes a bulge portion on its outer surface at one end in the direction of the arrangement of the rocker arms, which bulges outwards to define the communication passage therein, and a rib on the outer surface and connecting a side edge of the outer surface and the bulge portion. With such arrangement, the weight of the second particular rocker arm can be reduced, while ensuring the rigidity of the bulge portion defining the communication passage.

According to still a further feature of the present invention, the second particular rocker arm is formed from metal by injection molding. With such an arrangement, the communication passage which is not perfectly circular can be formed simultaneously with the formation of the second particular rocker arm, and the number of the post-workings can be reduced to a minimum to enhance the productivity.

The above and other objects, features and advantages of the invention will become apparent from the following description of the preferred embodiments taken in conjunction with the accompanying drawings.

BRIEF DESCRIPTION OF THE DRAWINGS

FIGS. 1 to 11 show a first embodiment of the present invention, wherein:

FIG. 1 is a vertical sectional view showing a portion of a valve operating system and taken along a line 1—1 in FIG. 2.

FIG. 2 is a plan view taken in a direction of an arrow 2 in FIG. 1.

FIG. 3 is a sectional view taken along a line 3—3 in FIG. 2.

FIG. 4 is a sectional view taken along a line 4—4 in FIG. 3.

FIG. 5 is an enlarged sectional view taken along a line 5—5 in FIG. 2.

FIG. 6 is a sectional view taken along a line 6—6 in FIG. 2.

FIG. 7 is a sectional view taken along a line 7—7 in FIG. 4.

FIG. 8 is a sectional view taken along a line 8—8 in FIG. 2.

FIG. 9 is a sectional view taken along a line 9—9 in FIG. 4.

FIG. 10 is a sectional view taken along a line 10—10 in FIG. 9.

FIG. 11 is a sectional view taken along a line 11—11 in FIG. 2.

DETAILED DESCRIPTION OF THE PREFERRED EMBODIMENTS

The present invention will now be described by way of embodiments with reference to the accompanying drawings.

Figure 1:
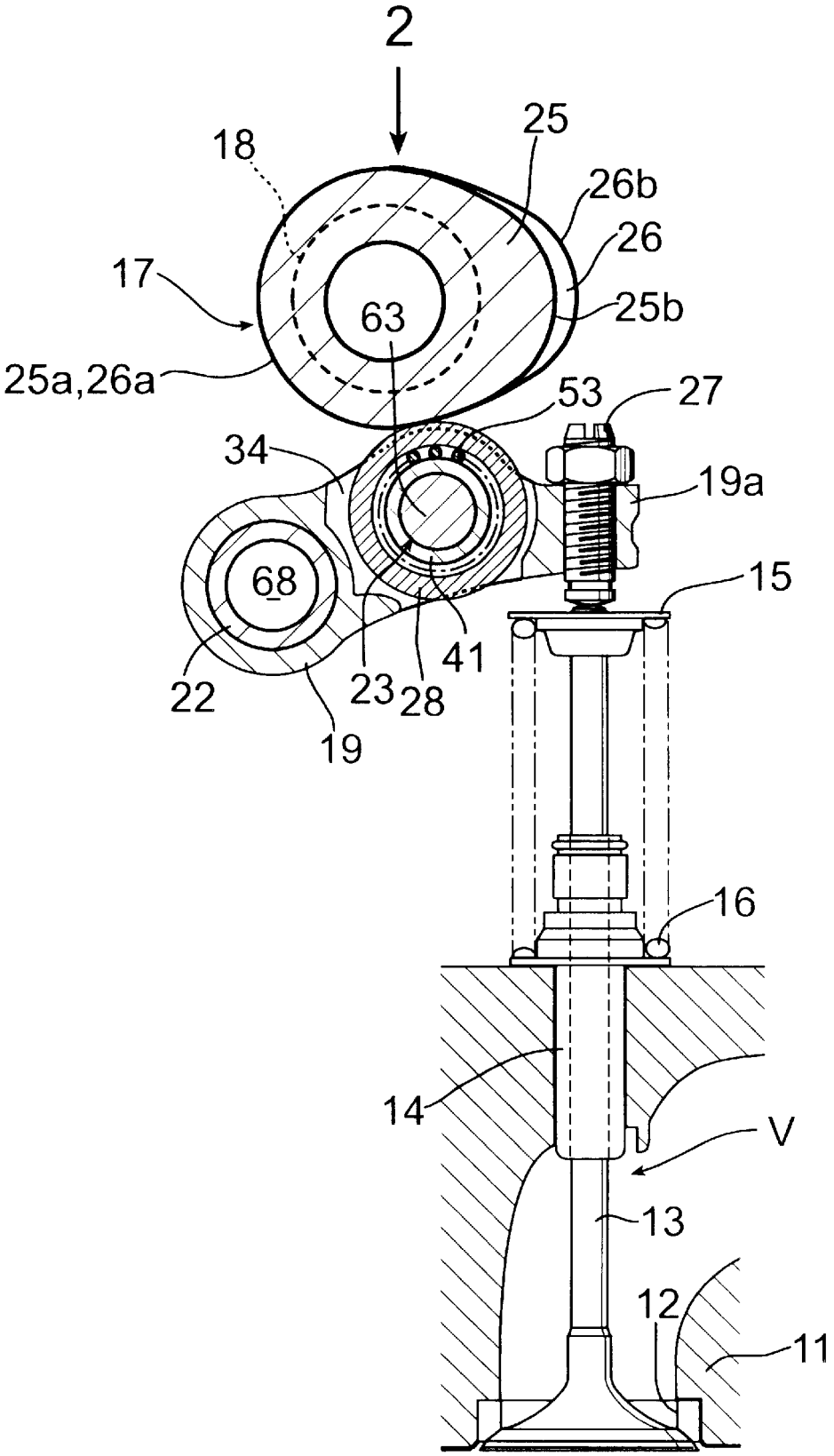

A first embodiment of the present invention will be described with reference to FIGS. 1 to 11. Referring first to FIG. 1, a pair of intake valve bores 12 are provided for each of cylinders in a cylinder head 11 in a multi-cylinder engine, e.g., a serial 4-cylinder internal combustion engine. The intake valve bores 12 are individually opened and closed by intake valves V as engine valves. The intake valves V have stems 13 which are slidably received in guide tubes 14 provided in the cylinder head 11. Valve springs 16 are mounted between retainers 15 at upper ends of the stems 13 protruding upwards from the guide tubes 14 and the cylinder head 11 to surround the stems 13, so that the intake valves V are biased by spring forces of the valve spring in a direction to close the intake valve bores 12.

Figure 2:
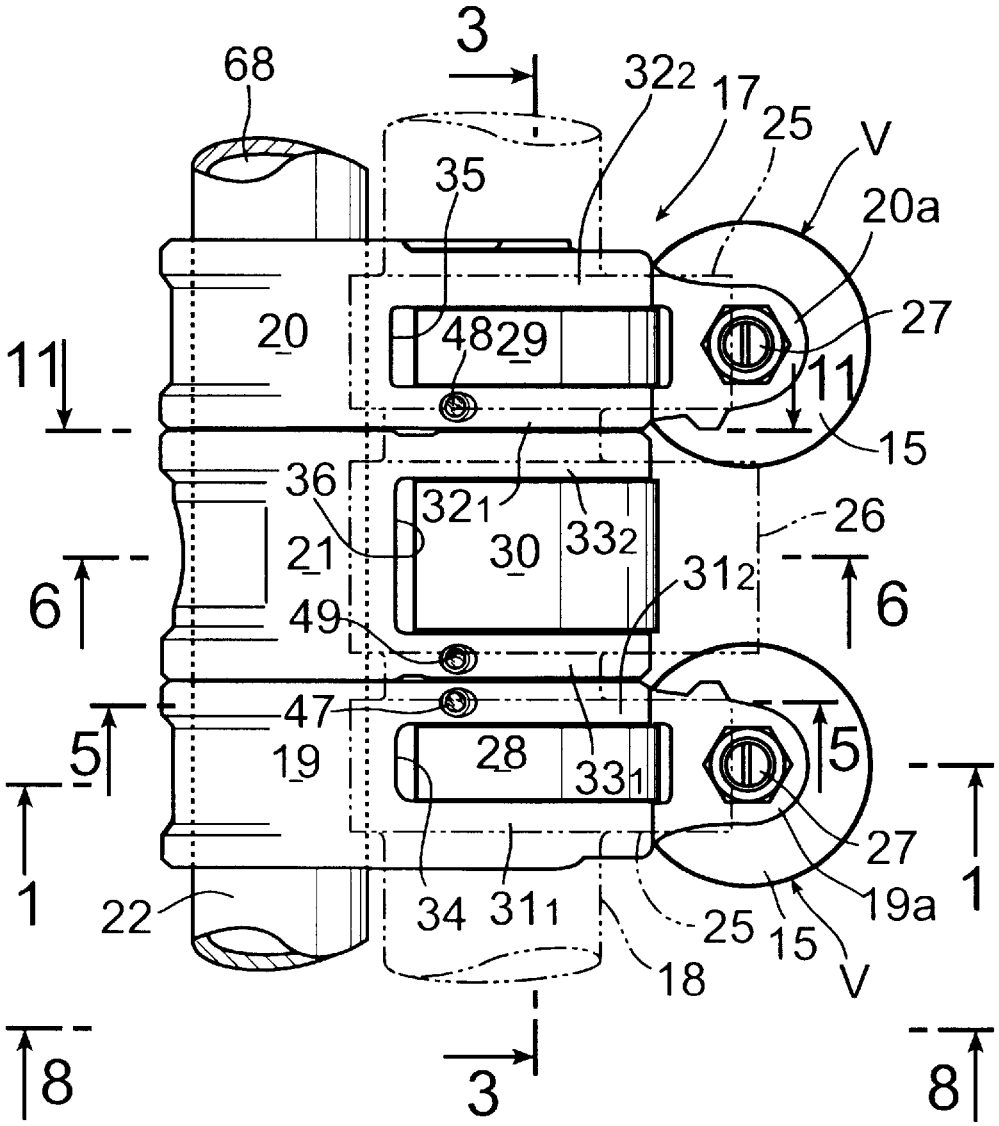
Figure 3:
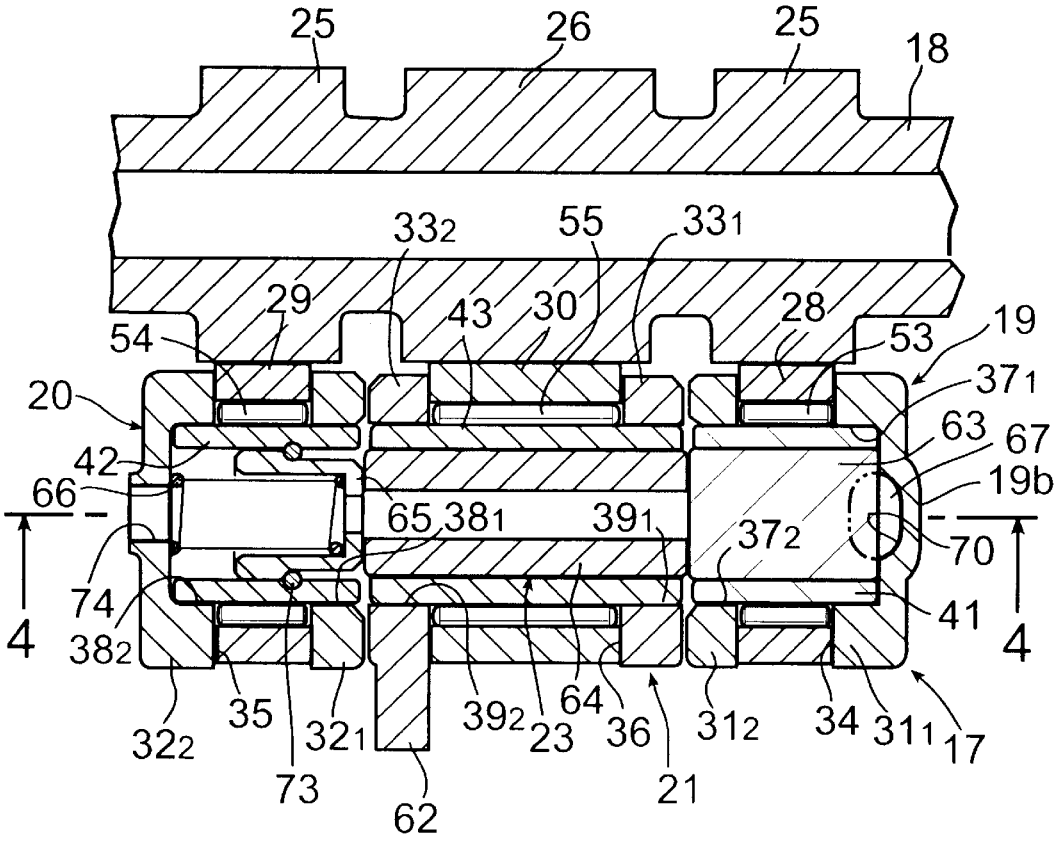
Figure 4:
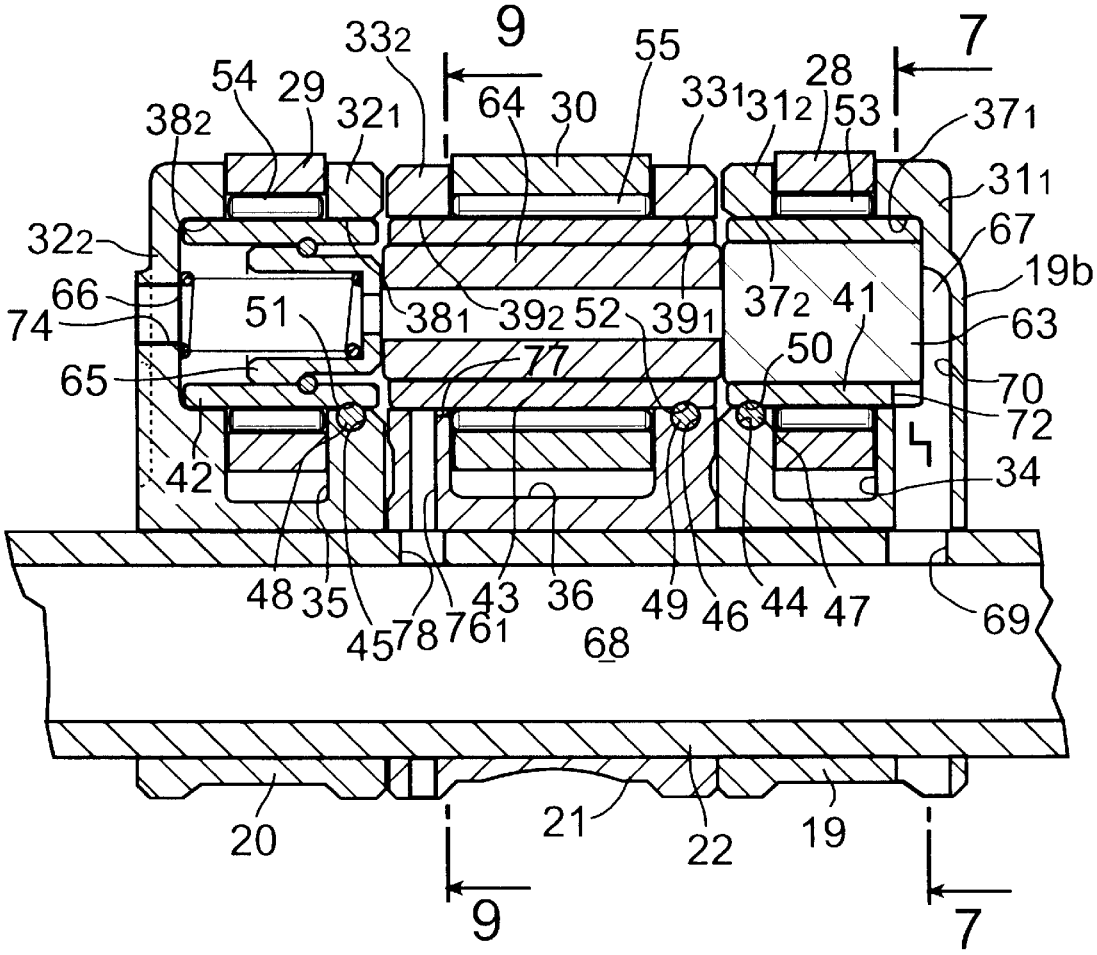

Referring to FIGS. 2 to 4, a valve operating device 17 is connected to the intake valves V and includes a cam shaft 18 operatively connected to a crankshaft (which is not shown) at a reduction ratio of ½, a first driving rocker arm 19 as a second particular rocker arm, which is operatively connected to one of the intake valves V, a second driving rocker arm 20 operatively connected to the other intake valve V, a free rocker arm 21 as a first particular rocker arm, which is capable of becoming free relative to the intake valves V. A stationary rocker shaft 22 as a support member, commonly supports the rocker arms 19, 20 and 21 for swinging movement and has an axis parallel to the cam shaft 18. An associative operation switching means 23 switches the associative operation and the release of the associative operation of the rocker arms 19, 20 and 21.

A high-speed valve operating cam 26 and lower-speed valve operating cams 25 are fixedly provided on the cam shaft 18. The lower-speed valve operating cams 25 are positioned on opposite sides of the high-speed valve operating cam 26 in correspondence to the intake valves V, respectively.

The high-speed valve operating cam 26 has a cam profile permitting the intake valves V to be opened and closed in a high-speed operational range of the engine, and includes an arcuate base circle-portion 26*a* about the axis of the cam shaft 18, and a cam lobe 26*b* protruding radially outwards from the base circle-portion 26*a*. The low-speed valve operating cam 25 has a cam profile permitting the intake valves V to be opened and closed in a lower-speed operational range of the engine, and includes a base circle-portion 25*a* formed into an arcuate shape about the axis of the cam shaft 18, and a cam lobe 25*b* which protrudes outwards radially of the cam shaft 18 from the base circle-portion 25*a* at an protrusion amount smaller than that of the cam lobe 26*b* from the base circle-portion 26*a* in the high-speed valve operating cam 26 and over a range of center angle narrower than that of the cam lobe 26*b*. Thus, the high-speed valve operating cam 26 has a cam profile ensuring a lift amount of the intake valve V larger than that of the low-speed valve operating cam 25.

The first driving rocker arm 19, the second driving rocker arm 20 and the free rocker arm 21 are positioned adjacent one another such that the free rocker arm 21 is interposed between the first and second driving rocker arms 19 and 20, and the arms 19, 20 and 21 are swingably supported commonly by the rocker shaft 22.

The first and second driving rocker arms 19 and 20 are integrally provided with arm portions 19*a* and 20*a* extending toward the intake valves V. Tappet screws 27 abutting against the upper ends of the stems 13 of the intake valves V, are threadedly engaged with tip ends of the arm portions 19*a* and 20*a* for advancing and retreating movements.

An opening 34 is provided in the first driving rocker arm 19 between the rocker shaft 22 and the tappet screw 27, and opens on upper and lower sides to form, on opposite sides, first and second support walls $\mathbf{31}_1$ and $\mathbf{31}_2$ opposed to each other in a direction parallel to the axis of the rocker shaft 22. A cylindrical roller 28 in rolling contact with the low-speed valve operating cam 25 is rollably supported on the first driving rocker arm 19 such that it is positioned in the opening 34. An opening 35 is provided in the second driving rocker arm 20 between the rocker shaft 22 and the tappet screw 27, and opens on upper and lower sides to form, on opposite sides, first and second support walls $\mathbf{32}_1$ and $\mathbf{32}_2$ opposed to each other in a direction parallel to the axis of the rocker shaft 22. A cylindrical roller 29 in rolling contact with the low-speed valve operating cam 25 is rollably supported on the second driving rocker arm 20 such that it is positioned in the opening 35. Further, an opening 36 is provided in the free rocker arm 21 and opens on the opposite side from the rocker shaft 22 and on upper and lower sides to form, on opposite sides, first and second support walls $\mathbf{33}_1$ and $\mathbf{33}_2$ opposed to each other in a direction parallel to the axis of the rocker shaft 22. A cylindrical roller 30 in rolling contact with the high-speed valve operating cam 26 is rollably supported on the free rocker arm 21 such that it is positioned in the opening 36.

A first fitting bore $\mathbf{37}_1$ opening toward the free rocker arm 21, is provided in the first support wall $\mathbf{31}_1$ of the first driving rocker arm 19 in parallel to the axis of the rocker shaft 22, and a second fitting bore $\mathbf{37}_2$ opening on opposite ends is provided in the second support wall $\mathbf{31}_2$ coaxially with the first fitting bore $\mathbf{37}_1$. A first fitting bore $\mathbf{38}_1$ opening on opposite ends is provided in the first support wall $\mathbf{32}_1$ of the second driving rocker arm 20 on the side of the free rocker arm 21, in parallel to the axis of the rocker shaft 22, and a second closed end fitting bore $\mathbf{38}_2$ opening toward the free rocker arm 21, is provided in the second support wall $\mathbf{32}_2$ coaxially with the first fitting bore $\mathbf{38}_1$. A first fitting bore $\mathbf{39}_1$ opening at opposite ends is provided in the first support wall $\mathbf{33}_1$ of the free rocker arm 21 on the side of the first driving rocker arm 19 in parallel to the axis of the rocker shaft 22, and a second fitting bore $\mathbf{39}_2$ opening at opposite ends is provided in the second support wall $\mathbf{33}_2$ coaxially with the first fitting bore $\mathbf{39}_1$.

One end of a cylindrical support shaft 41 is fitted into the first fitting bore $\mathbf{37}_1$ in the first driving rocker arm 19, until it abuts against the closed end of the first fitting bore $\mathbf{37}_1$, and the other end of the support shaft 41 is fitted into the second fitting bore $\mathbf{37}_2$. One end of a cylindrical support shaft 42 is fitted into the first fitting bore $\mathbf{38}_1$ in the second driving rocker arm 20, and the other end of the support shaft 42 is fitted into the second fitting bore $\mathbf{38}_2$, until it abuts against the closed end of the second fitting bore $\mathbf{38}_2$. Further, opposite ends of a cylindrical support shaft 43 are fitted into the first and second fitting bores $\mathbf{39}_1$ and $\mathbf{39}_2$ in the free rocker arm 21, respectively.

Figure 5:
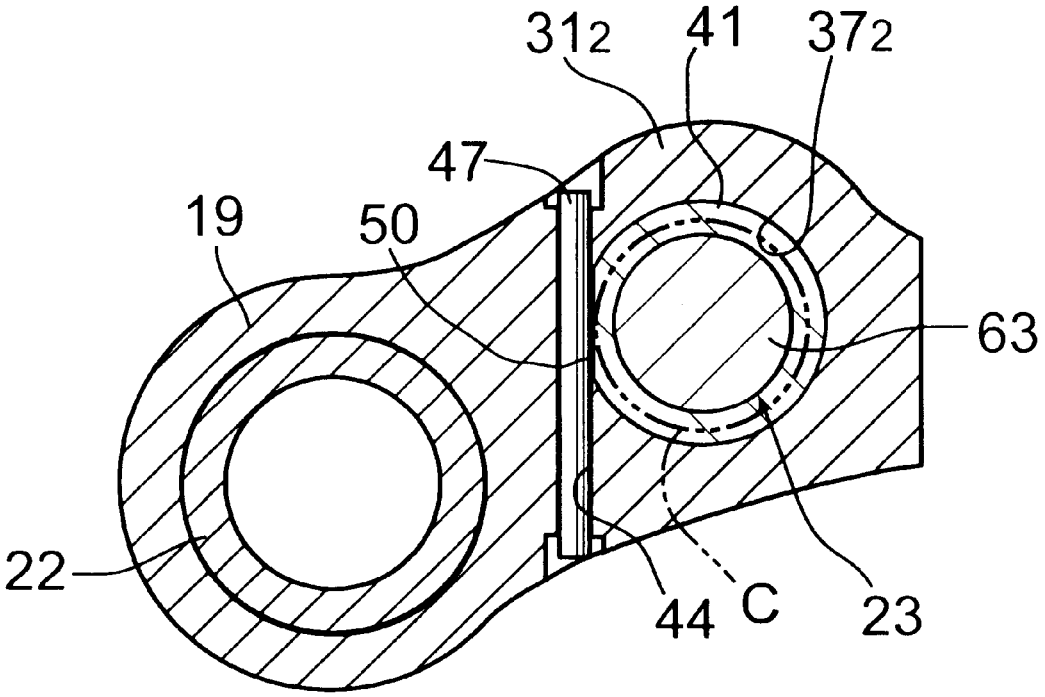

Referring also to FIG. 5, an insert bore 44 is provided in the second support wall $\mathbf{31}_2$ of the first driving rocker arm 19, and extends in a direction intersecting a straight line connecting axes of the rocker shaft 22 and the second fitting bore $37_2$ to lead to an inner surface of the second fitting bore $37_2$. An engage groove 50 is provided in an outer surface of the support shaft 41 in correspondence to an opening of the insert bore 44 into the inner surface of the second fitting bore $37_2$, and extends along a direction tangent to a phantom circle C about the axis of the support shaft 41. A pin 47 is inserted into and fixed in the insert bore 44, for example, by press-fitting such that an intermediate portion thereof engages into the engage groove 50, whereby the support shaft 41 is fixed to the first driving rocker arm 19.

The support shaft 42 is fixed to the first support wall $32_1$ of the second driving rocker arm 20 in a structure similar to a structure for fixing the support shaft 41 to the first driving rocker arm 19. More specifically, a pin 48 inserted into and fixed in an insert bore 45 provided in the first support wall $32_1$ of the second driving rocker arm 20 is engaged in an engage groove 51 provided in an outer surface of the support shaft 42 fitted in the first fitting bore $38_1$.

Further, the support shaft 43 is fixed to the first support wall $33_1$ of the free rocker arm 21 in a structure similar to the structure for fixing the support shaft 41 to the first driving rocker arm 19 and a structure for fixing the support shaft 42 to the second driving rocker arm 20. More specifically, a pin 49 inserted into and fixed in an insert bore 46 provided in the first support wall $33_1$ of the free rocker arm 21, is engaged into an engage groove 52 provided in an outer surface of the support shaft 43 fitted in the first fitting bore $39_1$.

A needle bearing 53 is interposed between the roller 28 and the support shaft 41 between the first and second support walls $31_1$ and $31_2$ of the first driving rocker arm 19. A needle bearing 54 is interposed between the roller 29 and the support shaft 42 between the first and second support walls $32_1$ and $32_2$ of the second driving rocker arm 20. A needle bearing 55 is interposed between the roller 30 and the support shaft 43 between the first and second support walls $33_1$ and $33_2$ of the free rocker arm 21.

Figure 6:
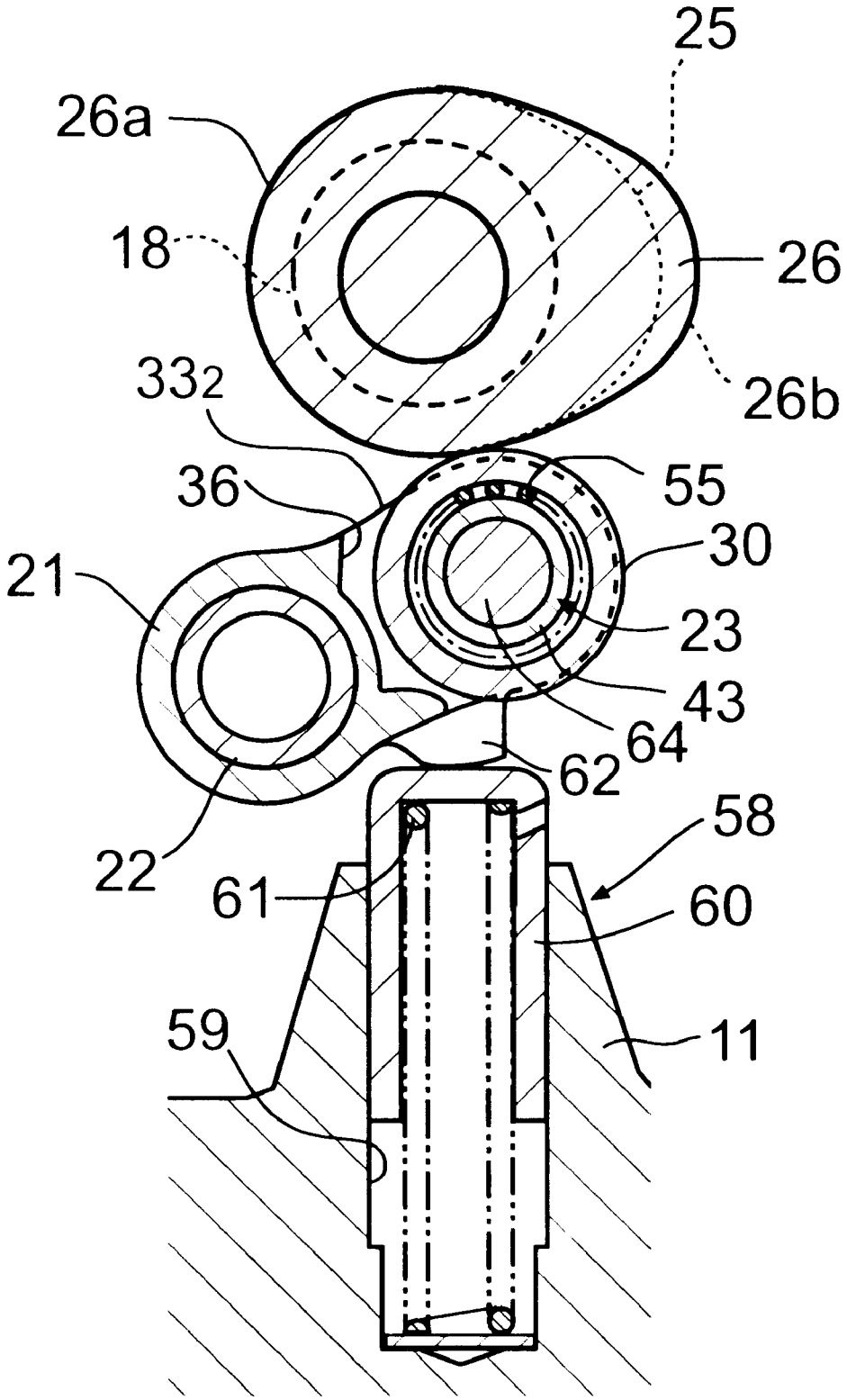

Referring to FIG. 6, a lost motion mechanism 58 is provided in the cylinder head 11 below the free rocker arm 21 and serves as an urging means for applying an urging force to the free rocker arm 21 in a direction to bring the roller of the free rocker arm 21 into rolling contact with the high-speed valve operating cam 26. The lost motion mechanism 58 comprises a closed end cylindrical lifter 60 slidably fitted in a closed end slide bore 59 provided in the cylinder head 11, with its upper portion opened, and a spring 61 mounted between the closed end of the slide bore 59 and the lifter 60.

The free rocker arm 21 includes a receiving portion 62 which is in contact with an upper end of the lifter to receive the spring force from the lost motion mechanism 58. In this case, although the pin 49 is inserted and fixed in the insert bore 46 to fix the support shaft 43 to one of the first and second support walls $33_1$ and $33_2$ included in the free rocker arm 21, the receiving portion 62 is integrally provided in a lower portion of the second support wall $33_2$ to bulge downwards.

The associative operation switching means 23 includes a timing piston 63 capable of switching the associative operation and the releasing of the associative operation of the first driving rocker arm 19 and the free rocker arm 21 adjoining each other, a cylindrical switching piston 64 capable of the associative operation and the releasing of the associative operation of the free rocker arm 21 and the second driving rocker arm 20 adjoining each other, a closed end cylindrical limiting member 65 which is in contact with the switching piston 64 on the opposite side from the timing piston 63, and a return spring 66 for biasing the limiting member 65 toward the switching piston 64.

The timing piston 63 is slidably fitted in the support shaft 41 of the first driving rocker arm 19, and a hydraulic pressure chamber 67 is defined between the closed end of the first fitting bore $37_1$ in which one end of the support shaft 41 is fitted, and one end of the timing piston 63. An oil passage 68 is provided, for example, coaxially in the rocker shaft 22, and connected to a hydraulic pressure source through a control valve which is not shown. A communication bore 69 is provided in the rocker shaft 22 to permit a communication passage 70 provided in the first support wall $33_1$ of the first driving rocker arm 19 with its one end leading to the hydraulic chamber 67, to be normally put into communication with the oil passage 68.

Figure 7:
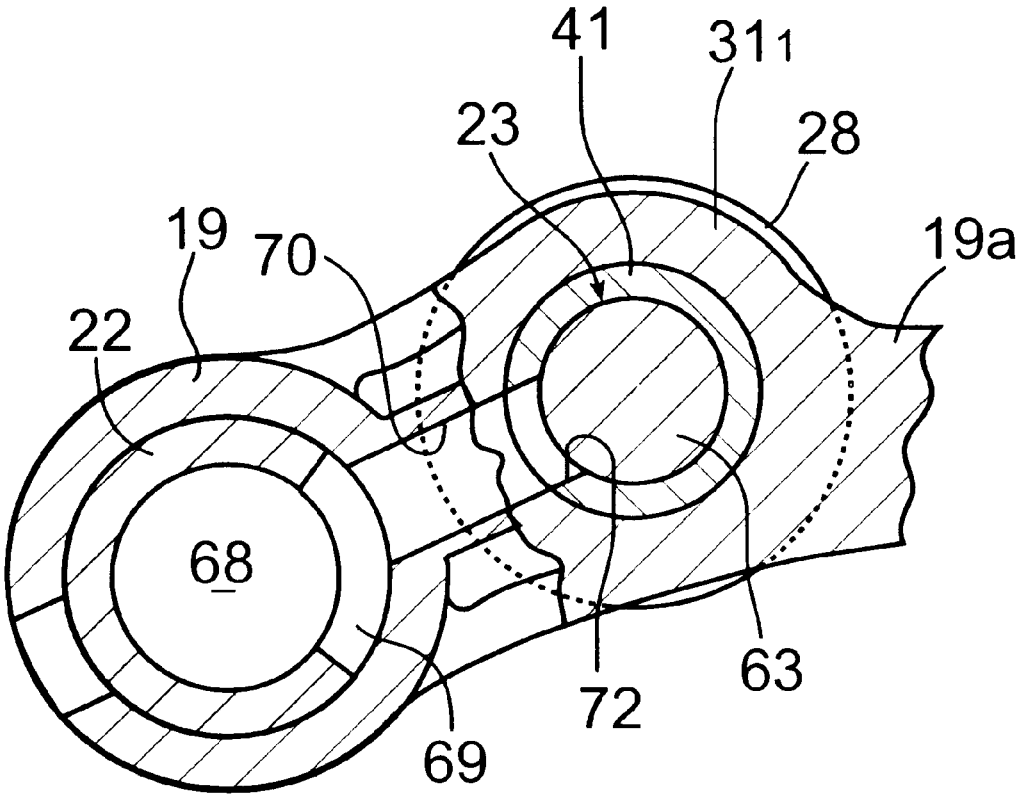

Referring to FIG. 7, the communication passage 70 is provided in the first driving rocker arm 19 on the side of the first support wall $31_1$, to extend in a plane substantially perpendicular to a direction of arrangement of the rocker arms 19, 20 and 21, and has a cross-sectional shape with a length longer in the direction perpendicular to the direction of arrangement of the rocker arms 19, 20 and 21, i.e., in a direction perpendicular to the axes of the cam shaft 18 and the rocker shaft 22, than a length in a direction along the direction of arrangement of the rocker arms 19, 20 and 21, i.e., in a direction along the axes of the cam shaft 18 and the rocker shaft 22. The communication bore 69 is provided in the rocker shaft 22, and extends greater in a circumferential direction of the rocker shaft 22 than it extends in communication with the communication passage 70, in order to normally put the oil passage 68 into the communication passage 70, irrespective of the swinging state of the first driving rocker arm 19. Moreover, the other end of the communication passage 70 opens into a side of the first driving rocker arm 19, and an intermediate portion of the communication passage 70 is cut off by the rocker shaft 22.

Figure 8:
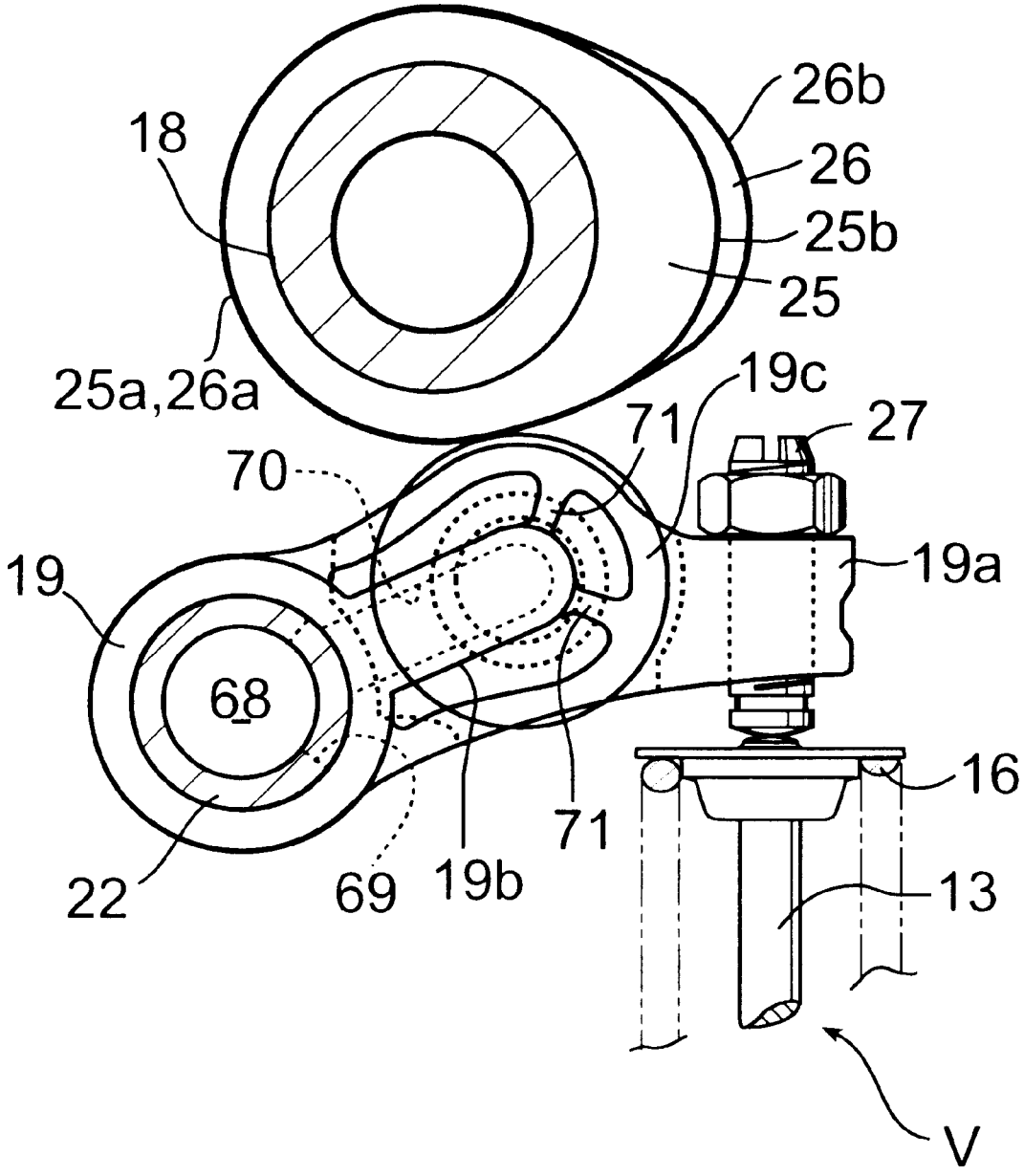

Referring also to FIG. 8, a bulge portion **19*b* bulging outwards to define the communication passage 70 is provided on an outer surface of the first driving rocker arm 19 at one end in the direction of arrangement of the rocker arms 19, 20 and 21, and a plurality of, e.g. two, ribs 71 are provided between a side edge 19*c* and the bulge portion 19*b* of the outer surface of the first driving rocker arm 19**.

The communication passage 70 is provided in the first driving rocker arm 19 in such a manner that a portion thereof is positioned nearer to the roller 28 than one end of the support shaft 41 in a direction parallel to the axis of the rocker shaft 22. A notch 72 having a shape corresponding to the communication passage is provided at a portion of the one end of the support shaft corresponding to the communication passage 70. Thus, working oil flowing through the communication passage 70 is introduced into the hydraulic pressure chamber 67 without hindrance to the flow thereof by the support shaft 41.

The switching piston 64 is slidably fitted in the support shaft 43 of the free rocker arm 21, with one end of the switching piston 64 being in contact with the other end of the timing piston 63 for sliding movement relative to each other.

The limiting member 65 is formed into a cylindrical shape having one closed end and slidably fitted into the support shaft 42 of the second driving rocker arm 20, with the closed end of the limiting member 65 being in contact with the other end of the switching piston 64 for sliding movement relative to each other. A retaining ring 73 is mounted on an inner surface of the support shaft 42 to abut against the limiting member 65 for preventing the limiting member 65 from dropping from the support shaft 42. The return spring 66 is mounted between the closed end of the second fitting bore $\mathbf{38}_2$ in the second driving rocker arm 20 and the limiting member 65, and an open bore 74 is formed in the closed end of the second fitting bore $\mathbf{38}_2$.

In the associative operation switching means 32, in the low-speed operational range of the engine, the hydraulic pressure in the hydraulic pressure chamber 67 is relative low, and contact faces of the timing piston 63 and the switching piston 64 lie at a location between the first driving rocker arm 19 and the free rocker arm 21, while contact faces of the switching piston 64 and the limiting member 65 lie at a location between the free rocker arm 21 and the second driving rocker arm 20. Therefore, the rocker arms 19, 20 and 21 are in relatively swingable states, so that the intake valves V are opened and closed with a timing and in a lift amount depending upon the low-speed valve operating cams 25.

In the high-speed operational range of the engine, a relatively high hydraulic pressure is applied to the hydraulic pressure chamber 67, so that the timing piston 63 is fitted into the support shaft 43 of the free rocker arm 21, while urging the switching piston 64, and the switching piston 64 is fitted into the support shaft 42 of the second driving rocker arm 20, while urging the limiting member 65. Therefore, the rocker arms 19, 20 and 21 are brought into an integrally connected state, and the intake valve V is opened and closed with a timing and in a lift amount depending upon the high-speed valve operating cam 26.

Figure 9:
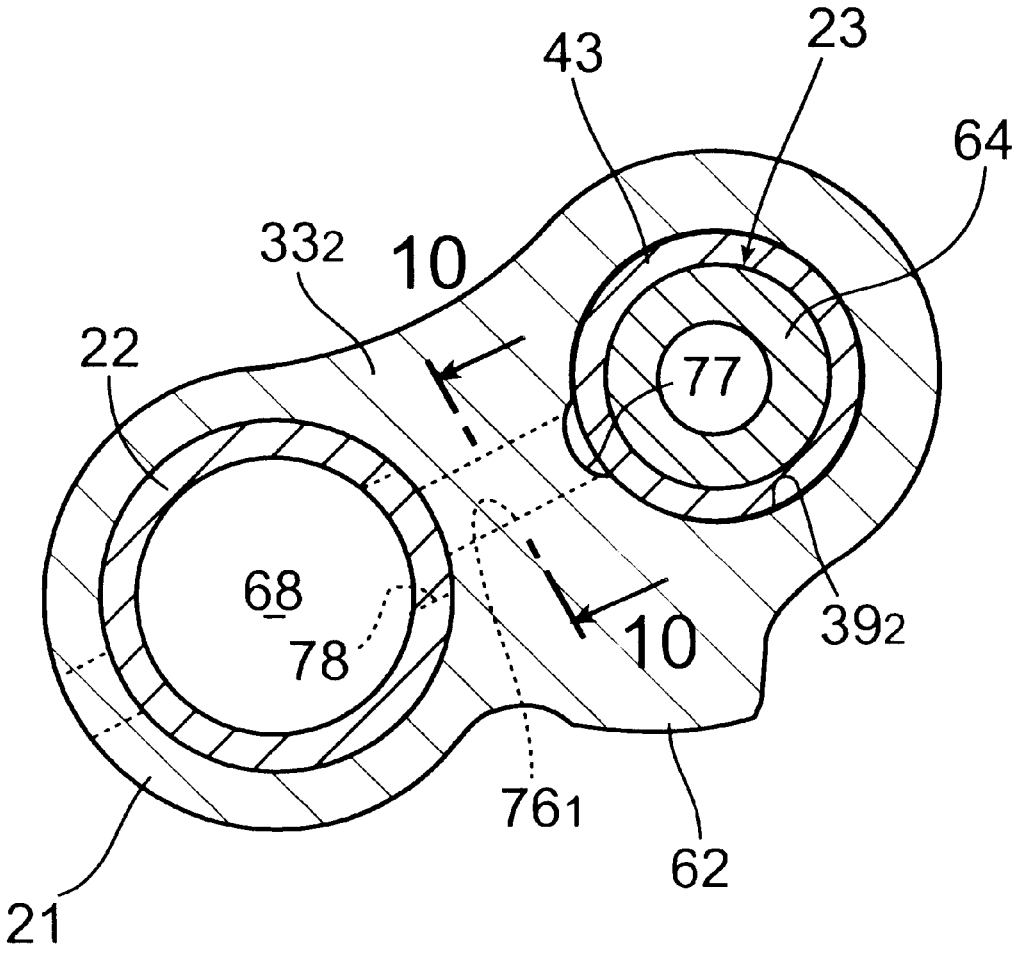
Figure 10:
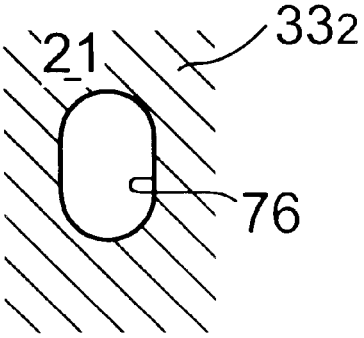

Referring also to FIGS. 9 and 10, a lubricating oil passage $\mathbf{76}_1$ normally leading to the oil passage 68 in the rocker shaft 22 is provided in one of the support walls $\mathbf{33}_1$ and $\mathbf{33}_2$ of the free rocker arm 21, i.e., in the second support wall $\mathbf{33}_2$ such that its one end opens into the inner surface of the second fitting bore $\mathbf{39}_2$. A groove 77 is provided in the inner surface of the second fitting bore $\mathbf{39}_2$ with one end leading to one end of the lubricating oil passage $\mathbf{76}_1$ and with the other end opening toward the bearing 55. The maximum depth of the groove 77 is set smaller than the radius of the needle of the needle bearing 55, so that the needle cannot enter the groove 77. Therefore, the direction of axial movement of the needle is reliably limited by the support walls $\mathbf{33}_1$ and $\mathbf{33}_2$, irrespective of the groove 77 being provided on the inner surface of the second fitting bore $\mathbf{39}_2$.

Moreover, the lubricating oil passage $\mathbf{76}_1$ is defined so as to have a cross-sectional shape with the length longer in the direction substantially perpendicular to the direction of arrangement of the rocker arms 19, 20 and 21, i.e., in the direction substantially perpendicular to the axes of the cam shaft 18 and the rocker shaft 22 than the length in the direction substantially parallel to the direction of arrangement of the rocker arms 19, 20 and 21, i.e., in the direction substantially parallel to the axes of the cam shaft 18 and the rocker shaft 22.

Figure 11:
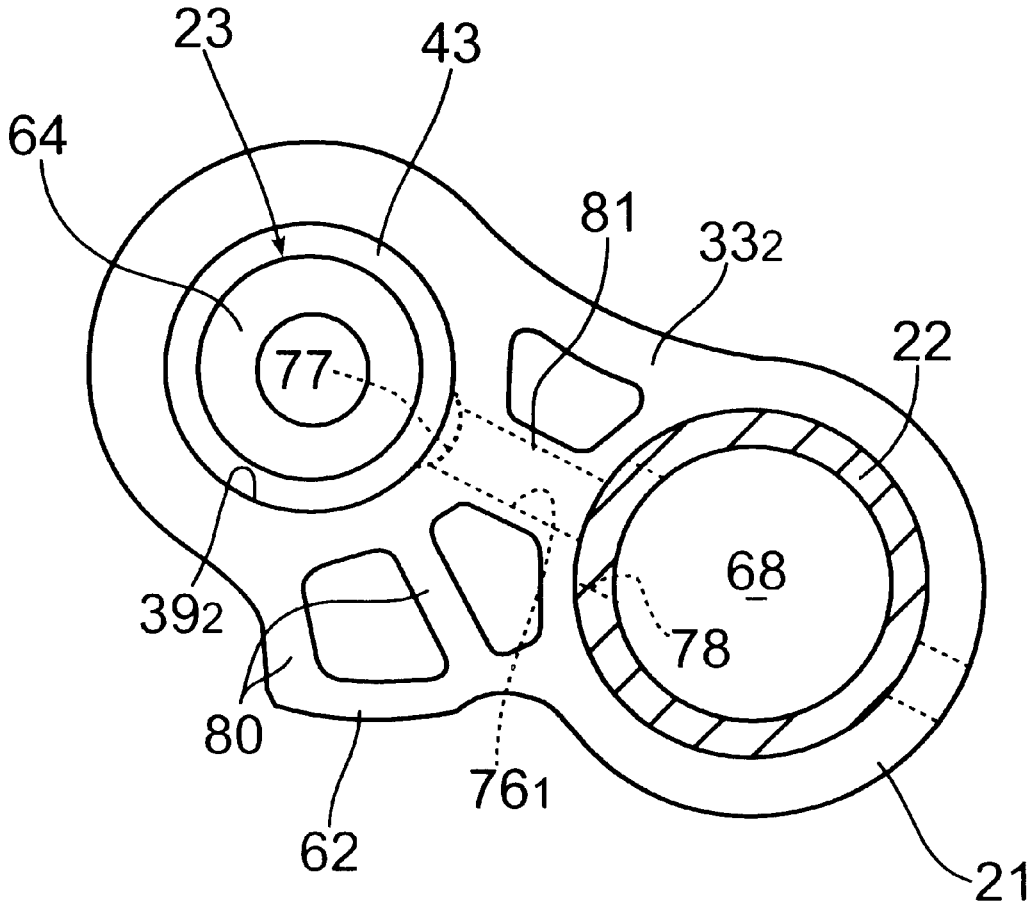

Referring to FIG. 11, the second support wall $\mathbf{33}_2$ of the free rocker arm 21 is provided with two ribs 80 for reinforcing the receiving portion 62 and with a rib 81 for reinforcing a section in which the hollow lubricating oil passage $\mathbf{76}_1$ is defined.

To ensure that the oil passage 68 is normally in communication with the lubricating oil passage $\mathbf{76}_1$, irrespective of the swinging state of the free rocker arm 21, a communication bore 78 is provided in the rocker shaft 22 which is larger in a circumferential direction of the rocker shaft 22 than the extent to which the lubricating oil passage $\mathbf{76}_1$ faces the outer surface of the rocker shaft 22. The other end of the lubricating oil passage $\mathbf{76}_1$ opens into a side of the free rocker arm 21, and an intermediate portion of the lubricating oil passage $\mathbf{76}_1$ is cut off by the rocker shaft 22.

The rocker arms 19, 20 and 21 are formed from metal by injection molding. In carrying out the metal injection molding, the following steps may be sequentially conducted: a step of kneading a starting powder and a binder such as wax and the like; a step of granulating the compound produced in the kneading step to provide a pellet; a step of subjecting the pellet to the injecting molding for shaping; a step of heating the shaped product to remove the binder; and a step of subjecting the resulting product to a sintering treatment.

The operation of the first embodiment will be described below. The support shafts 41, 42 and 43 for supporting the rollers 28, 29 and 30 for alleviating the valve operating load for rolling movement, are fixed to the rocker arms 19, 20 and 21, but the opposite ends of the support shafts 41, 42 and 43 are fitted into the first fitting bores $\mathbf{37}_1$, $\mathbf{38}_1$ and $\mathbf{39}_1$ and the second fitting bores $\mathbf{37}_2$, $\mathbf{38}_2$ and $\mathbf{39}_2$ in the rocker arms 19, 20 and 21, respectively. Moreover, by the fact that the pin 47 inserted and fixed in the insert bore 44 provided in the second support wall $\mathbf{31}_2$ of the first driving rocker arm 19, is engaged in the engage groove 50 in the support shaft 41; the pin 48 inserted and fixed in the insert bore 45 provided in the first support wall $\mathbf{32}_1$ of the second driving rocker arm 20, is engaged in the engage groove 51 in the support shaft 42, and the pin 49 inserted and fixed in the insert bore 46 provided in the first support wall $\mathbf{33}_1$ of the free rocker arm 21, is engaged in the engage groove 52 in the support shaft 43, the axial movement of the support shafts 41, 42 and 43 and the rotation of the support shafts 41, 42 and 43 about the axes are inhibited and therefore, the support shafts 41, 42 and 43 can be fixed to the rocker arms 19, 20 and 21 in a simple structure.

The communication passage 70 connecting the oil passage 68 in the rocker shaft 22, with the hydraulic pressure chamber 67 in the associative operation switching means 23 is provided to extend in a plane substantially perpendicular to the direction of arrangement of the rocker arms 19, 20 and 21. The communication passage 70 has a cross-sectional shape with a length longer in the direction perpendicular to the direction of arrangement of the rocker arms 19, 20 and 21 than the length in the direction substantially parallel to the direction of arrangement of the rocker arms 19, 20 and 21. Therefore, the space occupied by the communication passage 70 in the direction parallel to the direction arrangement of the rocker arms 19, 20 and 21 can be reduced to a minimum, and the size of the first driving rocker arm 19 can be correspondingly reduced.

Moreover, in the first driving rocker arm 19, the support shaft 41 is fixed to the first driving rocker arm 19 with its one end fitted in the first fitting bore $\mathbf{37}_1$ in the first support wall $\mathbf{31}_1$. However, the communication passage 70 is provided in the first driving rocker arm 19 on the side of the first support wall $\mathbf{31}_1$, thus the communication passage 70 can be positioned, while avoiding an increase in thickness of the first support wall $\mathbf{31}_1$ for fixing the support shaft 41 supporting the roller 28. In addition, since the notch 72 having a shape corresponding to the communication passage 70 is provided at the portion of the one end of the support shaft 41 which corresponds to the communication passage 70, the communication passage 70 can be positioned in closer proximity to the roller 28, while ensuring a sufficient contact area of the support shaft with the first fitting bore $37_1$ in the first support wall $31_1$ included in the first driving rocker arm 19. This ensures the strength for supporting the support shaft 41 on the first driving rocker arm 19. Thus, the size of the first driving rocker arm 19 can be reduced.

The size of the first driving rocker arm 19 can be reduced in the above manner, and thus the size of the cylinder head 11 can be remarkably reduced in the multi-cylinder internal combustion engine as in the present invention.

Since the bulge portion 19*b* bulging outwards to define the communication passage 70 is provided on the outer surface of the first driving rocker arm 19 at one end thereof in the axial direction of the rocker shaft 22, and the ribs 71 connecting the side edge 19*c* of the outer surface and the bulge portion 19*b* are provided on the outer surface, the weight of the first driving rocker arm 19 can be reduced, while ensuring the rigidity of the bulge portion 19*b* which defines the communication passage 70.

Further, since the communication passage 70 is provided in the first support wall $31_1$ of the first driving rocker arm 19, and the insert bore 44 for fixing the support shaft 41 is provided in the second support wall $31_2$ with the roller 28 positioned between the second support wall $31_2$ and the fist support wall $31_1$ , the space for provision of the insert bore 44 can be ensured, while avoiding an increase in size of the first driving rocker arm 19, and the insert bore 44 is provided at the location relatively far apart from the hollow communication passage 70. This is convenient for the rigidity of the first driving rocker arm 19.

The lubricating oil passage $76_1$ is provided in the free rocker arm 21 to lead to the oil passage 68 in the rocker shaft 22 with one end opening into the inner surface of the second fitting bore $39_2$, and the groove 77 is provided in the inner surface of the second fitting bore $39_2$ with one end thereof leading to the one end of the lubricating oil passage $76_1$ and with the other end opening toward the needle bearing 55. Therefore, lubricating oil is supplied from the oil passage 68 through the lubricating oil passage $76_1$ and the groove 77 to the needle bearing 55. Thus, it is possible to supply lubricating oil to the needle bearing 55 in a simple structure in which the lubricating oil passage $76_1$ is provided in the free rocker arm 21 and the groove 77 is provided in the inner surface of the second fitting bore $39_2$, and the oil passage structure for supplying lubricating oil to the needle bearing 55 can be easily formed. Therefore, it is unnecessary to make a bore for introducing lubricating oil to the support shaft 43; and there is no possibility of a reduction in rigidity of the support shaft 43, and the number of workings is reduced.

The free rocker arm 21 is moved following the high-speed valve operating cam 26 having the cam profile for the high-speed operation of the engine, which provides a relatively large inertial weight and a relatively large load on the needle bearing 55. However, lubricating oil can be effectively supplied to the needle bearing in the above-described simple structure, thereby providing a reduction in load applied to the needle bearing 55.

Moreover, since the lubricating oil passage $76_1$ is defined to have a cross-sectional shape with the length larger in the direction substantially perpendicular to the axis of the cam shaft 18, i.e., in the direction substantially perpendicular to the direction of arrangement of the rocker arms 19, 20 and 21, than the length in the direction substantially parallel to the axis of the cam shaft 18, i.e., in the direction substantially parallel to the direction of arrangement of the rocker arms 19, 20 and 21, the space occupied by the lubricating oil passage $76_1$ in the direction parallel to the axis of the cam shaft 18, i.e., in the direction parallel to the direction of arrangement of the rocker arms 19, 20 and 21, can be reduced to a minimum, and the size of the free rocker arm 21 can be reduced. This also enables a reduction in size of the cylinder head 11 in the multi-cylinder internal combustion engine.

In the free rocker arm 21, the lubricating oil passage $76_1$ is provided in the second support wall $33_2$, while the insert bore 46 for fixing the support shaft 43, is provided in the first support wall $33_1$. Therefore, the space for provision of the insert bore 46 can be ensured, while avoiding an increase in size of the free rocker arm 21. In addition, the insert bore 44 is provided at a location relatively spaced apart from the hollow lubricating oil passage $76_1$. This is convenient for the rigidity of the free rocker arm 21.

The free rocker arm 21 includes the receiving portion 62 which is in contact with the lifter 60 of the lost motion mechanism 58, but the receiving portion 62 is integrally provided at the lower portion of the second support wall $33_2$. Therefore, the structure of the free rocker arm 21 can be simplified such that the receiving portion 62 is positioned to the side of the roller 30, and an increase in size of the free rocker arm 21 can be avoided, whereby the inertial weight of the free rocker arm 21 can be reduced to conveniently accommodate the high-speed operation of the internal combustion engine.

Moreover, since the support shaft 43 is fixed to the first support wall $33_1$ by the pin 49, while the receiving portion 62 is provided on the second support wall $33_2$, the size and the position of the insert bore 46 for insertion and fixing of the pin 49 is not limited by the receiving portion 62, and it is difficult for the load from the lost motion mechanism 58 to act on the pin 49, whereby the fixing strength of the support shaft 43 can be increased. In addition to this, since the receiving portion 62 is integrally provided on the second support wall $33_2$, the reduction in rigidity of the second support wall $33_2$ can be avoided, despite the provision of the hollow lubricating oil passage $76_1$ being provided in the second support wall $33_2$, and the balance of weight of the support walls $33_1$ and $33_2$ can be improved in such a manner that the receiving portion 62 compensates for the reduction in weight of the second support wall $33_2$ caused by the fact the lubricating oil passage $76_1$ is hollow.

Further, the free rocker arm 21 is supported on the rocker shaft 22 in such a manner that the first support wall $33_1$ provided with the insert bore 46 for fixing the support shaft 43, is positioned on the first driving rocker arm 19. The second driving rocker arm 20 is supported on rocker shaft 22 in such a manner that the first support wall $32_1$ provided with the insert bore 45 for fixing the support shaft 42 is positioned on the first driving rocker arm 19. The support shafts 43 and 42 are fixed to the free rocker arm 21 and the second driving rocker arm 20 at locations in which the timing piston 63 and the switching piston 64 of the associative operation switching means 23 are inserted. Therefore, the insertion of the pistons 63 and 64 into the support shafts 43 and 42 is smooth, and the switching operation of the associative operation switching means is smooth.

The rocker arms 19, 20 and 21 are formed from metal by the injection molding. The communication passage 70 which is not perfectly circular, the fitting bores $37_1$ and $37_2$ and the insert bore 44, can be formed simultaneously with the formation of the first driving rocker arm 19, and the fitting bores $38_1$ and $38_2$, the insert bore 45 and the opened bore 74 can be formed simultaneously with the formation of the second driving rocker arm 20. The lubricating oil passage $76_1$ which is not truly circular, the fitting bores $39_1$ and $39_2$ and the insert bore 46, can be formed simultaneously with the formation of the free rocker arm 21. Therefore, it is possible to decrease the steps of post-working of the rocker arms 19, 20 and 21 to a minimum to enhance the productivity.

The lubricating oil passage $76_1$ is formed in the free rocker arm 21 as a closed end bore without opening into the inner surface of the fitting bore $39_2$ upon the formation of the free rocker arm 21 from the metal by injection molding, and after the formation of the free rocker arm 21, the groove 77 is put into communication with the lubricating oil passage $76_1$, when the groove 77 is formed by machining in the inner surface of the fitting bore $39_2$. Thus, it is possible to avoid contact of a die for forming the fitting bore $39_2$ and a die for forming the lubricating oil passage $76_1$ with each other, when the free rocker arm 21 is formed from metal by injection molding.

Figure 12:
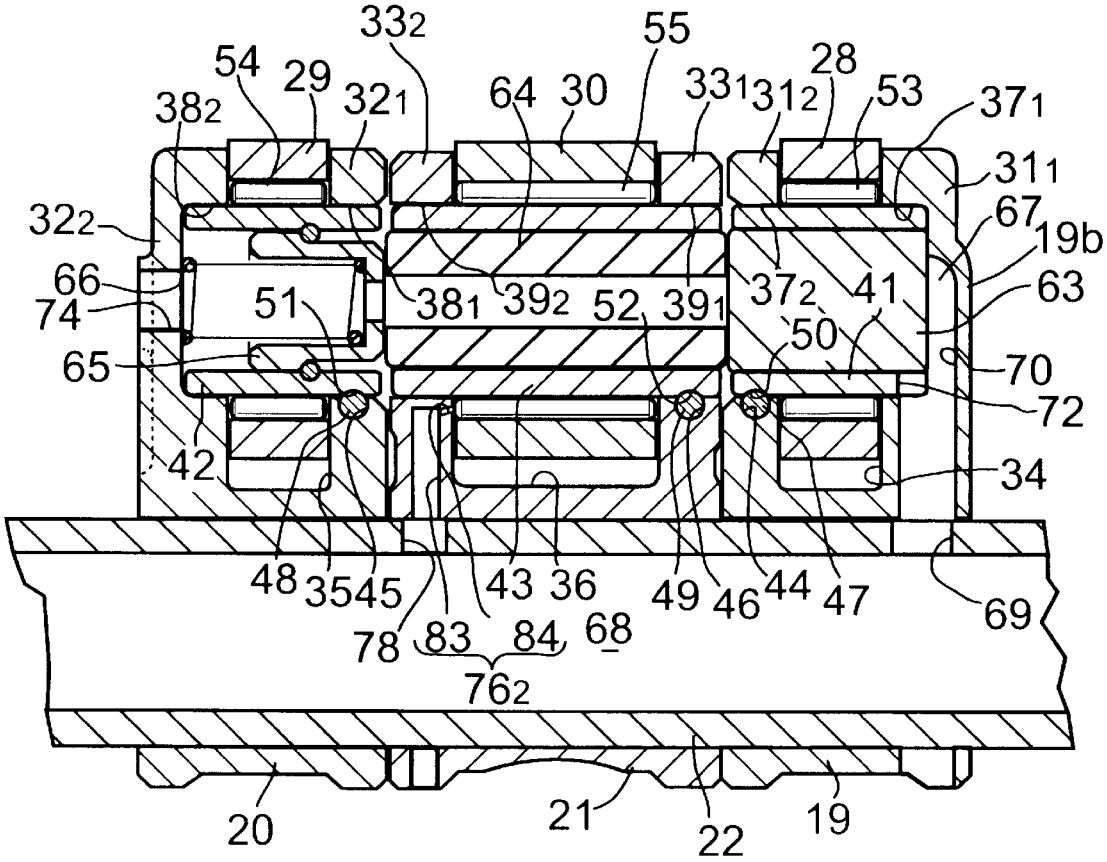
FIG. 12 is a sectional view similar to FIG. 4 according to a second embodiment of the present invention.

FIG. 12 shows a second embodiment of the present invention, wherein portions or components corresponding to those in the first embodiment are designated by like reference characters.

A lubricating oil passage $76_2$ is provided in a second support wall $33_2$ in a free rocker arm 21 to lead to an oil passage 68 in a rocker shaft 22 and to open toward a needle bearing 55.

The lubricating oil passage $76_2$ comprises a first closed end bore 83 extending in a direction substantially perpendicular to the axis of the rocker shaft 22 with one end closed at a location near the inner surface of the fitting bore $39_2$, and a second bore 84 with one end leading to the first bore 83 at a location near the one closed end of the first bore 83 and with the other end opening toward the needle bearing 55. The first bore 83 is formed simultaneously, when the free rocker arm 21 is formed from metal by injection molding. The other end of the first bore 83 opens into an outer surface of the free rocker arm 21, but the first bore 83 is put into communication with an oil passage 68 through a communication bore 78 by the rocker shaft 22 being positioned to traverse an intermediate portion of the first bore 83.

The second bore 84 is made by a drill after the formation of the free rocker arm 21 by injection molding, wherein the axis of the second bore 84 is established, so that an extension of the axis of the second bore 84, i.e., the axis of the drill passing through the fitting bore $39_1$ in the support wall $33_1$. Thus, it is possible to diminish, to a minimum, the inclination angle of the drill from a direction perpendicular to a work surface during drilling of the second bore 84, thereby improving the workability.

According to the second embodiment, lubricating oil is supplied from the oil passage 68 in the rocker shaft 22 through the lubricating oil passage $76_2$ to the needle bearing 55. Thus, the lubricating oil can be supplied to the needle bearing 55 in a simple structure in which the lubricating oil passage $76_2$ is only provided in the second support wall $33_2$ included in the free rocker arm 21, and the oil passage structure for supplying oil to the needle bearing can be easily formed, and moreover, it is unnecessary to drill the support shaft 43 for introducing lubricating oil. Therefore, there is not a possibility of reduction in rigidity of the support shaft 43, and further, the number of workings is reduced.

Moreover, the lubricating oil passage $76_2$ does not open into the fitting bore $39_2$ and hence, the entire inner surface of the fitting bore $39_2$ can be brought into contact with the outer surface of the support shaft 43, and the supporting area of the support shaft 43 is increased, whereby the supporting rigidity of the support shaft is further enhanced.

If an increase in size of the second support wall $33_2$ is permitted in a further embodiment of the present invention, a lubricating oil passage extending rectilinearly to lead to the oil passage 68 in the rocker shaft 22 and to open toward the needle bearing 55, may be provided in an inclined manner in the second support wall $33_2$.

The present invention is also applicable to a valve operating system for an exhaust valve of an engine valve.

The valve operating system in which the associative operation and the release of the associative operation of the plurality of rocker arms 19, 20 and 21 can be switched over from one to the other by the associative operation switching means 23, has been described in the above embodiments, but the present invention is applicable to a valve operating system in an internal combustion engine, which is designed so that a rocker arm is urged toward a valve operating cam by an urging means, irrespective of the presence or absence of the associative operation switching means.

The rocker arms 19, 20 and 21 are commonly and swingably supported on the rocker shaft 22 in each of the embodiments, but the present invention is applicable to a valve operating system having a structure in which a plurality of rocker arms are swingably supported on ends of separate support columns, respectively.

Further, if the urging means exhibiting the spring force as in the embodiment is used, the arrangement is not complicated, but an urging means exhibiting an urging force by a hydraulic pressure or the like may be used.

Although the embodiments of the present invention have been described in detail, it will be understood that the present invention is not limited to the above-described embodiments, and various modifications in design may be made without departing from the spirit and scope of the invention defined in claims.

What is claimed is:

1. A valve operating system in an internal combustion engine, comprising a plurality of rocker arms disposed adjacent one another, and an associative operation switching means having a timing piston defining a hydraulic pressure chamber between said timing piston and a particular one of said rocker arms, said switching means being capable of switching the associative operation and the releasing of the associative operation of said plurality of rocker arms in accordance with the operation of said timing piston in response to a variation in hydraulic pressure in said hydraulic pressure chamber, wherein said particular rocker arm is provided with a communication passage which permits an oil passage provided in a support member for swingably supporting said particular rocker arm to communicate with said hydraulic pressure chamber, and wherein said communication passage has a cross-sectional shape with a length thereof in a direction substantially perpendicular to a direction of arrangement of said rocker arms being longer than a length thereof in a direction substantially parallel to the direction of arrangement of said rocker arms, said communication passage being provided in said particular rocker arm along a plane substantially perpendicular to the direction of arrangement of said rocker arms.

2. A valve operating system in an internal combustion engine according to claim 1, wherein said particular rocker arm includes a first support wall having a first bottomed fitting bore provided therein, and a second support wall having a second fitting bore provided therein coaxially with said first fitting bore, said second fitting bore being open at opposite ends thereof, and said valve operating system further includes a cylindrical support shaft having opposite ends fitted into said first and second fitting bores and being fixed to said particular rocker arm, a roller placed in rolling contact with a valve operating cam and rotatably supported on said support shaft, said timing piston being slidably fitted in said support shaft, and said communication passage being provided in said particular rocker arm on the side of said first support wall.

3. A valve operating system in an internal combustion engine according to claim 2, wherein a notch having a shape corresponding to said communication passage is provided at one end of said support shaft which corresponds to said communication passage.

4. A valve operating system in an internal combustion engine according to claim 2, wherein said particular rocker arm includes an insertion bore therein on the side of said second support wall, said insertion bore leading to an inner surface of said second fitting bore, said support shaft has an engage groove in an outer surface thereof in correspondence to an opening of said insertion bore which opens into the inner surface of said second fitting bore, and a pin engaged in said engage groove is inserted into and fixed in said insertion bore.

5. A valve operating system in an internal combustion engine according to claim 3, wherein said particular rocker arm includes an insertion bore therein on the side of said second support wall, said insertion bore leading to an inner surface of said second fitting bore, said support shaft has an engage groove in an outer surface thereof in correspondence to an opening of said insertion bore which opens into the inner surface of said second fitting bore, and a pin engaged in said engage groove and inserted into and fixed in said insertion bore.

6. A valve operating system in an internal combustion engine according to claim 1, wherein said particular rocker arm includes a bulge portion on the outer surface thereof at one end in the direction of the arrangement of said rocker arms, said bulge portion bulging outwards to define said communication passage, and said particular rocker arm includes a rib on said outer surface, connecting a side edge of said outer surface and said bulge portion.

7. A valve operating system in an internal combustion engine according to claim 2, wherein said particular rocker arm includes a bulge portion on the outer surface thereof at one end in the direction of the arrangement of said rocker arms, said bulge portion bulging outwards to define said communication passage, and said particular rocker arm includes a rib on said outer surface, connecting a side edge of said outer surface and said bulge portion.

8. A valve operating system in an internal combustion engine according to claim 3, wherein said particular rocker arm includes a bulge portion on the outer surface thereof at one end in the direction of the arrangement of said rocker arms, said bulge portion bulging outwards to define said communication passage, and said particular rocker arm includes a rib on said outer surface, connecting a side edge of said outer surface and said bulge portion.

9. A valve operating system in an internal combustion engine according to claim 4, wherein said particular rocker arm includes a bulge portion on the outer surface thereof at one end in the direction of the arrangement of said rocker arms, said bulge portion bulging outwards to define said communication passage, and said particular rocker arm includes a rib on said outer surface, connecting a side edge of said outer surface and said bulge portion.

10. A valve operating system in an internal combustion engine according to claim 5, wherein said particular rocker arm includes a bulge portion on the outer surface thereof at one end in the direction of the arrangement of said rocker arms, said bulge portion bulging outwards to define said communication passage, and said particular rocker arm includes a rib on said outer surface, connecting a side edge of said outer surface and said bulge portion.

11. A valve operating system in an internal combustion engine according to claim 1, wherein each of said rocker arms is formed from metal by injection molding.

12. A valve operating system in an internal combustion engine according to claim 2, wherein said rocker arms are formed from metal by injection molding.

13. A valve operating system in an internal combustion engine according to claim 1, further including a cam shaft provided with a valve operating cam, one of said rocker arms having first and second support walls which are opposed to each other at a distance and which have fitting bores provided therein, respectively, a support shaft which is fitted at opposite ends thereof into said fitting bores and fixed to said one rocker arm, a roller placed in rolling contact with said valve operating cam and rotatably supported on said support shaft with a bearing interposed therebetween, a lubricating oil passage which is provided in said one rocker arm and which opens into an inner surface of at least one of said fitting bores provided in said rocker arm, said lubricating oil passage leading to said oil passage in said support member, and a groove which is provided in the inner surface of said at least one of said fitting bores and which leads at one end to said lubricating oil passage and opens at the other end toward said bearing.

14. A valve operating system in an internal combustion engine according to claim 1, further including a cam shaft provided with a valve operating cam, one of said rocker arms having first and second support walls which are opposed to each other at a distance, a support shaft mounted to extend between said first and second support walls, a roller placed in rolling contact with said valve operating cam and rotatably supported on said support shaft with a bearing interposed therebetween and a lubricating oil passage which is provided in at least one of said support walls and which leads to said oil passage in said support member and opens toward said bearing.

15. A valve operating system in an internal combustion engine according to claim 1, further including a cam shaft provided with a plurality of valve operating cams, and wherein said plurality of rocker arms include one rocker arm which is moved to follow a high-speed one of said valve operating cam, said high-speed valve operating cam having a cam profile providing the maximum lift amount of an engine valve, said associative operation switching means having a plurality of pistons including said timing piston, said pistons being movable between a position in which said adjacent rocker arms are operated in association with each other and a position in which the associative operation is released, at least said one rocker arm of said plurality of rocker arms being provided with first and second support walls having fitting bores opposed to each other at a distance and coaxial with each other, and said valve operating system further includes a cylindrical support shaft which is fixed to said one rocker arm with opposite ends thereof fitted in said fitting bores to guide the sliding movement of said pistons, a roller placed in rolling contact with said high-speed valve operating cam rotatably supported via a bearing on said support shaft between both of said support walls, a lubricating oil passage which is provided in said one rocker arm and which opens into an inner surface of at least one of said fitting bores and leads to said oil passage in said support member, and a groove which is provided in the inner surface of said at least one fitting bore and which leads at one end to said lubricating oil passage and opens at the other end toward said bearing.

16. A valve operating system in an internal combustion engine according to claim 13, wherein said lubricating oil passage is provided in one of said support walls, the other support wall having an insertion bore which extends to an inner surface of said fitting bore provided in said other support wall, said support shaft having an engage groove on an outer surface thereof in correspondence to an opening of said insertion bore into the inner surface of said fitting bore, and wherein a pin engaged in said engage groove is inserted into and fixed in said insertion bore.

17. A valve operating system in an internal combustion engine according to claim 15, wherein said rocker arms are disposed adjacent one another such that another of said rocker arms different from said one rocker arm is disposed at one end in a direction of arrangement of said rocker arms, said associative operation switching means is arranged to be capable of switching the associative operation and the releasing of the associative operation of said rocker arms in accordance with the operation of said pistons in response to a variation in hydraulic pressure in a hydraulic pressure chamber defined within said another rocker arm; and an insertion bore is provided in one of said support walls included in said one rocker arm, which is disposed on the side of said another rocker arm, said insertion bore leading to an inner surface of said fitting bore provided in said one support wall, an engage groove being provided in an outer surface of said support shaft in correspondence to an opening of said insertion bore which opens into the inner surface of said fitting bore, and wherein a pin engaged in said engage groove is inserted into and fixed in said insertion bore, said lubricating oil passage being provided in one of said support walls which is disposed at a location farther from said other rocker arm.

18. A valve operating system in an internal combustion engine according to claim 15, wherein said lubricating oil passage has a cross sectional shape with a length thereof in a direction substantially perpendicular to the axis of said cam shaft being longer than a length thereof in a direction substantially parallel to the axis of said cam shaft.

19. A valve operating system in an internal combustion engine according to claim 13, wherein said rocker arms are formed from metal by injection molding.

* * * * *